US006387552B1

(12) United States Patent
Iyori et al.

(10) Patent No.: US 6,387,552 B1
(45) Date of Patent: May 14, 2002

(54) TICN-BASED CERMET

(75) Inventors: Yusuke Iyori; Yuichi Nakahara; Yoshio Kimura, all of Tokyo (JP)

(73) Assignee: Hitachi Tool Engineering, Ltd., Tokyo (JP)

( * ) Notice: Subject to any disclaimer, the term of this patent is extended or adjusted under 35 U.S.C. 154(b) by 0 days.

(21) Appl. No.: 09/666,538

(22) Filed: Sep. 21, 2000

(30) Foreign Application Priority Data

Sep. 21, 1999 (JP) ..... 11-266800
Aug. 28, 2000 (JP) ..... 12-257871

(51) Int. Cl.[7] ..... B32B 51/02; C22C 29/04

(52) U.S. Cl. ..... 428/698; 428/325; 75/238; 75/239; 75/240; 75/241; 75/242

(58) Field of Search ..... 428/698, 457, 428/469, 472, 325; 75/238, 239, 240, 241, 242

(56) References Cited

U.S. PATENT DOCUMENTS 4,145,213 A * 3/1979 Oskarsson et al. ..... 75/238
5,186,739 A * 2/1993 Osobe et al. ..... 75/238
5,306,326 A * 4/1994 Oskarsson et al. ..... 75/238
5,421,851 A * 6/1995 Oskarsson et al. ..... 75/238
5,470,372 A * 11/1995 Weinl ..... 75/238
5,552,108 A * 9/1996 Weinl et al. ..... 419/15
5,766,742 A * 6/1998 Nakamura et al. ..... 428/698
6,231,277 B1 * 5/2001 Abukawa ..... 407/119

FOREIGN PATENT DOCUMENTS

JP 09300108 A 11/1997
JP 11131170 A 5/1999

* cited by examiner

*Primary Examiner*—Archene Turner
(74) *Attorney, Agent, or Firm*—Sughrue Mion, PLLC

(57) ABSTRACT

A TiCN-based cermet comprises 5–25 weight % of a binder phase mainly composed of Co and/or Ni, the balance being substantially a hard phase and inevitable impurities, the hard phase being mainly composed of carbide, nitride and/or carbonitride and containing at least Ti and W, the cermet having a cross-section microstructure in which the number of Ti-rich particles having an area of 0.02 $\mu m^2$ or more is 1000 or less per a unit area of 1000 $\mu m^2$.

5 Claims, 1 Drawing Sheet

TICN-BASED CERMET

BACKGROUND OF THE INVENTION

The present invention relates to a cermet used for cutting tools, milling tools, etc., particularly to a TiCN-based cermet having excellent crack resistance and wear resistance.

Cermets are typical materials for cutting tools like cemented carbides, though the former is slightly poorer in toughness than the latter. Thus, a lot of attempts have been made so far to improve the toughness of cermets. The most effective means may be the addition of TiN or TiCN. Their addition contributes to improvement in toughness, because the microstructures of cermets are made finer with TiN or TiCN. Investigation is presently conducted on further increase in the N content, fine pulverization of material powder and sintering techniques to improve the toughness of cermets. Thus, ultra-fine grain cermets similar to ultra-fine grain cemented carbides are now available.

In-depth research has also been conducted on the microstructures of cermets. For instance, Japanese Patent Laid-Open No. 11-131170 proposes an excellent cermet tool obtained by optimally controlling the shape of TiCN particles in its structure. Japanese Patent Laid-Open No. 9-300108 proposes a cermet tool excellent in wear resistance, which is obtained by causing TiWMCN, wherein M is at least one of Zr, V, Nb and Ta, to surround TiCN particles in the process of sintering.

Though a lot of research has conventionally been conducted on improvement in the toughness of cermets, drastic progress has not been achieved yet. Apart from the problem of toughness, cermets are subjected to extremely rapid notch wear than cemented carbides, and it is sometimes observed that the notch wear restricts the life of tools. Particularly in the case of cutting materials having relatively high tensile strength such as hot-working tool steel, such phenomenon is extreme.

The causes of generating notch wear in cermet tools are considered in many ways such as oxidation wear, damage due to rapid change of thermal gradient, biting by chips remaining between a tool and a work, etc. Though contribution of each cause has been verified to some extent, the inventors have considered that they are not decisive causes. If the mechanism of generating notch wear of cermet tools were found so that the notch wear can be prevented, and if the toughness of cermets were further improved, the cermets would be provided with further improved properties suitable for tools.

OBJECT OF THE INVENTION

Thus, an object of the present invention is to provide a cermet with improved notch wear resistance and toughness.

SUMMARY OF THE INVENTION

Thus, the TiCN-based cermet according to the present invention comprises 5–25 weight % of a binder phase mainly composed of Co and/or Ni, the balance being substantially a hard phase and inevitable impurities, the hard phase being mainly composed of carbide, nitride and/or carbonitride and containing at least Ti and W, the cermet having a cross-section microstructure in which the number of Ti-rich particles having an area of 0.02 $\mu m^2$ or more is 1000 or less per a unit area of 1000 $\mu m^2$.

In a preferred embodiment of the present invention, the TiCN-based cermet has a crack resistance of 60 kg/mm or more. The TiCN-based cermet preferably has a cross-section microstructure in which the number of Ti-rich particles having an area of 0.02–0.4 $\mu m^2$ is ⅔ or more of the total number of Ti-rich particles having an area of 0.02 $\mu m^2$ or more.

The TiCN-based cermet is preferably coated with a hard material.

DETAILED DESCRIPTION OF THE PREFERRED EMBODIMENTS

[1] Microstructure of cermet

Figure 1:
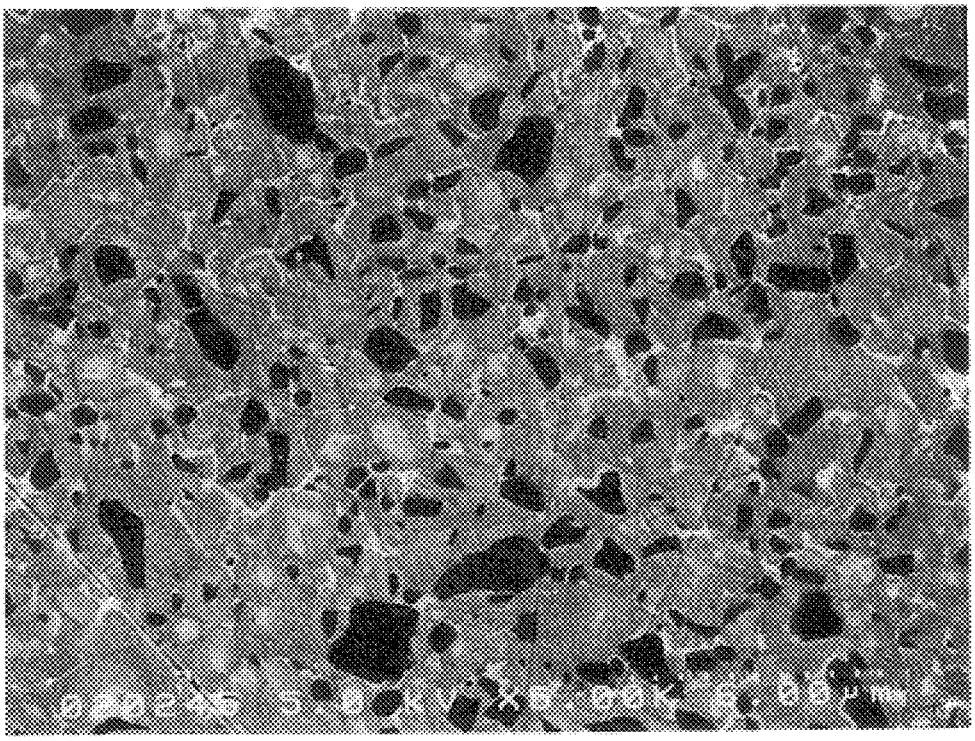
FIG. 1 is a scanning-type electron microscopic photograph showing the microstructure of the cermet of the present invention.

Before delving into the details of the microstructure of the cermet, the generation mechanism of notch wear in the cermet will be discussed. In view of an object of providing a cermet with improved notch wear resistance and toughness, the inventors have embarked on deciphering the generation mechanism of notch wear in cermets, resulting in the discovery that there appears a sign that notch wear occurs immediately after the initiation of cutting, and that the sign is fine cracks occurring in a flank of a cermet tool. Cracks are subjected to fusion and peeling in the course of cutting, resulting in a large wear in the flank.

Next, as a result of investigation of the properties of cermets that can suppress the generation of such fine cracks, it has been found that there are extremely good correlations between the suppression of fine cracks and a so-called crack resistance, which is expressed by a value (kg/mm) obtained by dividing a load in a Vickers hardness test by the total length of cracks appearing around a point at which the load is applied. As is well known, the crack resistance, which is correlated with fracture toughness, can more easily be measured than the fracture toughness.

Thus, the above two separate objects, improvement in the toughness of cermets and the suppression of notch wear, have been unified to an object of improving the crack resistance of cermets.

Careful investigation of the propagation routes of cracks has revealed that the finer the particles (grains) in the cermet, the more easily cracks propagate, contrary to the conventionally accepted theory. In general, relatively fine hard particles have small cores rich in Ti (observed as black spots in a scanning-type electron microscopic photograph) in the case of having a layer structure, and fine hard particles rich in Ti without a layer structure are small in diameter. In any case, it has been observed regardless of the TiCN content in a cermet that when Ti-rich particles are smaller, leading to a larger number when counted at the same cermet composition, cracks propagate more easily, resulting in decrease in the crack resistance of the cermet.

Accordingly, the particle size of starting material powder, the milling conditions of powder and sintering conditions have been investigated to provide cermets with various particle size distributions, to verify a strong correlation between the number of Ti-rich particles and the crack resistance of the resultant cermet.

FIG. 1 is a scanning-type electron microscopic photograph (×5000) of the microstructure of a cermet of the present invention. Ti-rich particles are observed as relatively black spots in the scanning-type electron microscopic photograph. The Ti-rich particles may be TiCN, TiN. Analyzing the scanning-type electron microscopic photograph by a proper image analysis software, it has been found that the cermet is provided with improved toughness when the number ($N_B$) of the Ti-rich particles having an area of 0.02 $\mu m^2$ or more is 1000 or less, preferably 800 or less, per a unit area of 1000 $\mu m^2$.

When the number of such Ti-rich particles is extremely small, these particles do not make substantial contribution to how cracks propagate, providing a different fracture mechanism. Thus, this case is not within the scope of the present invention. To achieve the effects of the present invention, it is necessary that the number $N_B$ of the Ti-rich particles having an area of 0.02 $\mu m^2$ or more is at least 50 per a unit area of 1000 $\mu m^2$. In the case of FIG. 1, the number of the Ti-rich particles having an area of 0.02 $\mu m^2$or more is 284 in a measured area of 432 $\mu m^2$. Thus, $N_B$ is calculated as about 657. Because $N_B$ indicates the existence probability of TiCN, the value of $N_B$ may vary to some extent. However, when the counting of $N_B$ is carried out for an area of not less than 400 $\mu m^2$ in a scanning-type electron microscopic photograph, the variation of $N_B$ can fully be suppressed.

Ti-rich layered particles without having black cores may exist in the microstructure, depending on the production method and composition of the cermet.

Taking into consideration the distribution of Ti-rich particles in addition to their number, further improvement in the properties of cermets can be obtained. When ⅔ or more, preferably ⅘ or more of the total number of Ti-rich particles having an area of 0.02 $\mu m^2$ or more are occupied by particles having an area of 0.02–0.4 $\mu m^2$, the resultant cermet is provided with fully improved toughness and wear resistance, whereby it may be useful for practical applications. Because the number of particles satisfying the above conditions is 246 in the cermet shown in FIG. 1, a ratio of the number of particles having an area of 0.02–0.4 $\mu m^2$ to the number of all particles having an area of 0.02 $\mu m^2$or more is calculated as about 0.87. With respect to huge Ti-rich particles having an area exceeding 2 $\mu m^2$, their number is preferably 1% or less based on the total number of Ti-rich particles having an area of 0.02 $\mu m^2$ or more, because the existence of more than 1% of such huge particles deteriorates the toughness and wear resistance of the cermet.

As described above, the TiCN content is not restrictive in the cermet of the present invention. Even though the cermet has a relatively small TiCN content, $N_B$ would be large, resulting in decrease in toughness, if each particle is relatively large. Also, the Ti-rich particles may have any shape. Regardless of circular or elongated shape, there is no substantial difference in properties for tool materials.

With respect to an area of each particle in the scanning-type electron microscopic photograph, it inevitably varies to some extent depending on observation conditions such as an observation means, magnification of the microscopic photograph, etc. For instance, a transmission electron microscope can observe extremely fine particles, while a scanning-type electron microscope provides slight difference in observed areas of particles depending not only on its magnification and acceleration voltage but also on whether or not it is a field emission-type (FE-SEM). Therefore, it should be construed that the area of 0.02 $\mu m^2$ is approximately a value more than 0.01 $\mu m^2$ and less than 0.03 $m^2$. Incidentally, whether or not particles of less than 0.02 $\mu m^2$ exist in the cermet of the present invention does not matter, because they do not exert any appreciable influence.

[2] Composition of cermet

The cermet of the present invention comprises 5–25 weight % of a binder phase mainly composed of Co and/or Ni, the balance being substantially a hard phase and inevitable impurities. The hard phase is constituted by particles (grains) mainly composed of carbide, nitride and/or carbonitride and containing at least Ti and W.

The binder phase of less than 5 weight % would make the cermet too brittle, while the binder phase of more than 25 weight % would not provide the cermet with enough hardness. The more preferred content of the binder phase is 15–20 weight %.

The elements constituting the hard phase may be Ti, W, Mo, Ta, Nb, Zr, Hf, etc., Ti and W being indispensable. The hard phase may be in the form of TiCN, WC, $Mo_2C$, TaC, NbC, ZrC, HfC, etc. When other elements than Ti and W are contained, the content of (Ti+W) in the form of hard phases such as carbides, nitrides or their solid solution is preferably 60–85 weight % based on the total amount (100 weight %) of the microstructure including the binder phase. When the content of (Ti+W) in the form of hard phases is less than 60 weight %, the cermet does not exhibit enough wear resistance because of a small content of Ti. On the other hand, when the content of (Ti+W) in the form of hard phases is more than 85 weight %, the cermet rather has a poor mechanical strength because of too much Ti. The more preferred content of (Ti+W) is 65–80 weight %. Incidentally, a weight ratio of Ti/W may be 2.5/1 to 4/1.

[3] Crack resistance

The cermet of the present invention has a crack resistance of 60 kg/mm or more. The crack resistance, whose unit is "kg/mm", is determined by dividing a load (kg) applied to the cermet in a Vickers hardness test by the total length (mm) of cracks appearing on the cermet around a point at which the load is applied. When the crack resistance is less than 60 kg/mm, the cermet has insufficient toughness, sometimes failing to be used for tools. The crack resistance of the cermet is preferably 80 kg/mm or more.

[4] Coating

When a coating of hard materials such as TiC, TiN, TiCN, TiAlN, etc. is applied to the cermet of the present invention, the cermet is provided with further improved wear resistance. The coating method may not be restricted to a physical vapor deposition or a chemical vapor deposition, and a proper coating method can be utilized. Also, coating materials may be properly selected. The thickness of the coating is preferably 1–10 $\mu m$.

[5] Production process

Starting material powders such as TiN, TiC, TiCN, WC, $Mo_2C$, TaC, NbC, ZrC, HfC, milling conditions sintering conditions, etc. may be selected, to adjust the number of Ti-rich particles in the cermets having various compositions. Particularly the sintering conditions are preferably selected to adjust the number and size of Ti-rich particles.

A cermet is principally sintered in a non-equilibrium state. When sintering is carried out at a high temperature for a long period of time, the concentration distributions of elements are made flat, resulting in decrease in the number and size of Ti-rich particles. However, the Ti-rich particles may become larger depending on sintering processes, though their number decreases. This is caused by a phenomenon that Ti-rich particles once dissolved in a metal phase are precipitated in another Ti-rich phase. Also, when sintering is carried out in a nitrogen atmosphere, nitrides are prevented from being decomposed, and dissolved Ti combine with nitrogen in the ambient atmosphere, resulting in increase in the number of Ti-rich particles. On the contrary, when sintering is carried out in an atmosphere having a low nitrogen partial pressure that does not suppress the decomposition of nitrides, the number of Ti-rich particles can be decreased.

Accordingly, it is possible to dissolve TiCN finely pulverized by milling in a metal binder by keeping a high temperature, and precipitate TiCN from the metal binder by keeping a certain temperature during a cooling process, thereby decreasing the number of fine TiCN particles while increasing the number of large TiCN particles. The heat treatment may be carried out simply keeping the temperature for a predetermined period of time during the course of cooling.

The present invention will be described in detail referring to the following EXAMPLES without intention of limiting the present invention thereto.

EXAMPLES 1–8, COMPARATIVE EXAMPLES 1–8

Each starting material powder was weighed and mixed at a composition ratio shown in Table 1 with 2 weight % of a molding binder in an alcohol in an attritor for 5 hours.

TABLE 1

| | Composition of Cermet | |
|---|---|---|
| No. | Composition (weight %) | Powder Used |
| a | 60TiCN-20WC-10TaC-5$Mo_2C$-5Ni | TiN, TiC, WC, $Mo_2C$, TaC, Ni |
| b | 55TiCN-20WC-10TaC-5$Mo_2C$-5Ni-5Co | TiCN, WC, $Mo_2C$, TaC, Ni, Co |
| c | 55TiCN-15WC-10TaC-5$Mo_2C$-5Ni-10Co | TiCN, WC, $Mo_2C$, TaC, Ni, Co |
| d | 55TiCN-15WC-10TaC-10Ni-10Co | TiCN, WC, TaC, Ni, Co |
| e | 50TiCN-15WC-10TaC-10Ni-15Co | TiCN, WC, TaC, Ni, Co |

The resultant slurry was dried and granulated by a spray-drying method. The resultant granules were molded by a die press and subjected to sintering under the conditions shown in Table 2. After cutting a surface of the resultant sintered body to a depth of 5 mm, the exposed surface was lapped with a diamond grinding powder to provide a sample with a mirror surface for observation of its microstructure.

TABLE 2

| | Sintering Conditions | | | |
|---|---|---|---|---|
| | Sintering Conditions | | | |
| No. | Tem.(1) (° C.) | Time(2) (min.) | Nitrogen Pressure(3) (Torr) | Temperature-Keeping(4) |
| A | 1580 | 10 | 0.5 | Yes |
| B | 1580 | 20 | 0.5 | No |
| C | 1550 | 100 | 0.3 | No |
| D | 1525 | 150 | 0.3 | Yes |
| E | 1525 | 10 | 0.5 | No |
| F | 1475 | 20 | 0.5 | No |
| G | 1450 | 100 | 0.5 | No |
| H | 1425 | 150 | 0.3 | No |

Note:
(1)Sintering temperature.
(2)A period of time during which the sintering temperature was held.
(3)Nitrogen pressure in a sintering atmosphere.
(4)Whether or not a temperature of 1480° C. was kept for 60 minutes at a nitrogen pressure of 1 Torr in the course of cooling from sintering.

The microstructure of each sample was investigated by FE-SEM (field emission-scanning-type electron microscope, magnification: 5000) to obtain a reflection secondary electron image, which was analyzed by a commercially available image-analyzing software to determine the number, size and distribution of particles. The crack resistance of each sample was measured under a load of 50 kgf in a Vickers hardness test. Table 3 shows the number ($N_B$) of Ti-rich particles having an area of 0.02 $\mu m^2$ or more per a unit area of 1000 $m^{2}$, the number ($N_s$) of Ti-rich particles having an area of 0.02–0.4 $\mu m^2$ per a unit area of 1000 $m^{2}$, a ratio of $N_S/N_B$, and the value of a crack resistance.

The same sintered bodies as above were worked to milling chips for a milling test. A work made of hot-die steel was cut by each milling chip at a cutting speed of 120 m/minute and a feeding speed of 0.2 mm/blade in a dry state, to measure a life until chipping took place in the milling chip and a width of notch wear in a flank. The results are shown in Table 3.

TABLE 3

| Sample No. | Comp.(1) | Sintering(2) | $N_B$ | $N_S$ | $N_S/N_B$ | CR(3) (kg/mm) | Wear(4) (mm) | Cutting Time(5) (min.) |
|---|---|---|---|---|---|---|---|---|
| 1 | a | A | 912 | 730 | 0.80 | 72 | 0.20 | 61 |
| 2 | b | B | 810 | 690 | 0.85 | 85 | 0.24 | 86 |
| 3 | c | C | 780 | 558 | 0.72 | 87 | 0.33 | 84 |
| 4 | d | D | 764 | 497 | 0.65 | 88 | 0.29 | 88 |
| 5 | e | D | 657 | 569 | 0.87 | 92 | 0.29 | 99 |
| 6 | | Sample 1 coated with TiN by PVD | | | | | 0.10 | 157 |
| 7 | | Sample 2 coated with TiCN by PVD | | | | | 0.13 | 183 |
| 8 | | Sample 3 coated with TiAlN by PVD | | | | | 0.16 | 167 |
| 9* | a | E | 1105 | 754 | 0.68 | 55 | 0.78 | 12 |
| 10* | b | F | 1010 | 478 | 0.47 | 59 | 0.82 | 18 |
| 11* | c | F | 1045 | 670 | 0.64 | 54 | 0.75 | 20 |
| 12* | d | G | 1122 | 912 | 0.81 | 52 | 0.87 | 22 |
| 13* | e | H | 1211 | 925 | 0.76 | 58 | 0.83 | 21 |
| 14* | | Sample 9 coated with TiN by PVD | | | | | 0.40 | 21 |
| 15* | | Sample 10 coated with TiCN by PVD | | | | | 0.45 | 33 |
| 16* | | Sample 11 coated with TiAlN by PVD | | | | | 0.50 | 41 |

Note:
(1)Composition.
(2)Sintering conditions.
(3)Crack resistance.
(4)Width of notch wear in a major flank of each sample.
(5)Cutting time until chipping took place.
*COMPARATIVE EXAMPLE In COMPARATIVE EXAMPLES, the width of notch wear in a flank exceeded 0.7 mm and the cutting life, a measure of whether the toughness is good or poor, was less than 30 minutes. On the other hand, in EXAMPLES, the width of notch wear in a flank was small, and the cutting life exceeded 60 minutes. Therefore, it is concluded that the cermets of the present invention have much better properties than those of COMPARATIVE EXAMPLES. More specifically, a smaller $N_B$ tends to provide a larger crack resistance and a higher resistance to chipping. Among them, the cermets with higher $N_S/N_B$ ratios tend to be less worn. Further, the cermets of the present invention are excellent in affinity for various coatings, providing much larger improvement in properties than the coated cermets of COMPARATIVE EXAMPLES.

As described above in detail, the present invention has solved both problems of toughness and notch wear, which are conventionally considered difficult to overcome simultaneously, by controlling the microstructure of a cermet. The cermet of the present invention exhibits excellent resistance to chipping and wear when used for milling tools. When generally used coatings are applied to the cermet of the present invention, particularly excellent effects are obtained by their synergy effects.

What is claimed is:

1. A TiCN-based cermet comprising 5–25 weight % of a binder phase mainly composed of Co and/or Ni, the balance being substantially a hard phase and inevitable impurities, said hard phase being mainly composed of carbide, nitride and/or carbonitride and containing at least Ti and W, said cermet having a cross-section microstructure in which the number of Ti-rich particles having an area of 0.02 $m^2$ or more is from 50 to 1000 per a unit area of 1000 $\mu m^2$.

2. The TiCN-based cermet according to claim 1, wherein said cermet has a crack resistance of 60 kg/mm or more.

3. The TiCN-based cermet according to claim 1, wherein said cermet has a cross-section microstructure in which the number of Ti-rich particles having an area of 0.02–0.4 $\mu m^2$ is ⅔ or more of the total number of Ti-rich particles having an area of 0.02 $\mu m^2$ or more.

4. The TiCN-based cermet according to claim 2, wherein said cermet has a cross-section microstructure in which the number of Ti-rich particles having an area of 0.02–0.4 $\mu m^2$ is ⅔ or more of the total number of Ti-rich particles having an area of 0.02 $\mu m^2$ or more.

5. The TiCN-based cermet according to claims 1, wherein said cermet is coated with a hard material.

* * * * *